US009812249B2

(12) United States Patent
Paterson et al.

(10) Patent No.: US 9,812,249 B2
(45) Date of Patent: Nov. 7, 2017

(54) SYSTEM AND METHOD FOR VEHICLE POWER SYSTEM ISOLATION

(71) Applicant: The Boeing Company, Chicago, IL (US)

(72) Inventors: John T. Paterson, Mukilteo, WA (US); Donald B. Lee, Shoreline, WA (US); Terry L. Thomas, Covington, WA (US); Richard W. Berman, Sammamish, WA (US); George Liang, Bothell, WA (US)

(73) Assignee: The Boeing Company, Chicago, IL (US)

( * ) Notice: Subject to any disclaimer, the term of this patent is extended or adjusted under 35 U.S.C. 154(b) by 74 days.

(21) Appl. No.: 14/486,428

(22) Filed: Sep. 15, 2014

(65) Prior Publication Data

US 2015/0002257 A1 Jan. 1, 2015

Related U.S. Application Data

(62) Division of application No. 12/892,871, filed on Sep. 28, 2010, now Pat. No. 8,836,160.

(51) Int. Cl.
*H01F 27/24* (2006.01)
*H01F 27/34* (2006.01)
(Continued)

(52) U.S. Cl.
CPC ..... *H01F 27/343* (2013.01); *H01F 27/02* (2013.01); *H01F 27/06* (2013.01); *H01F 27/24* (2013.01); *H01F 27/29* (2013.01); *H01F 27/32* (2013.01)

(58) Field of Classification Search
CPC ..... H01F 27/00–27/32
(Continued)

(56) References Cited

U.S. PATENT DOCUMENTS 2,114,189 A * 4/1938 Kronmiller ..... H01F 27/365 123/633
2,904,762 A * 9/1959 Schulz ..... H01F 27/362 336/171

(Continued)

OTHER PUBLICATIONS

Akihiko Yagasaki, "Isolation Transformers to Prevent the Propagation of Lightning Surges along Power Lines: the Problem Involved and the Effects of the Improvement", J. Inst. Electrostat. Jpn., vol. 25, Issue 6, 2001, p. 311-319, Seidenki Gakkai, Japan (English Abstract).

(Continued)

*Primary Examiner* — Tuyen Nguyen
(74) *Attorney, Agent, or Firm* — Thompson Hine LLP

(57) ABSTRACT

A linear optimized isolation transformer may include a magnetic core having a primary side and a secondary side; a primary side winding on the primary side; a primary side terminal electrically coupled to the primary side winding; a secondary side winding on a the secondary side; a secondary side terminal electrically coupled to the secondary side winding; an isolation dielectric placed between the primary side winding and the secondary side winding and having a shape that fills all of the space between the primary side and the secondary side that is not occupied by the core, the isolation dielectric including a permanent high-Q material selected to maintain a high value isolation independent of pressure differences resulting from operation at different altitudes; and wherein the primary side terminal and the secondary side terminal are positioned on opposing ends of a long axis of the magnetic core.

17 Claims, 6 Drawing Sheets

(51) Int. Cl.

| | |
|---|---|
| ***H01F 27/02*** | (2006.01) |
| ***H01F 27/06*** | (2006.01) |
| ***H01F 27/29*** | (2006.01) |
| ***H01F 27/32*** | (2006.01) |

(58) Field of Classification Search
USPC ... 336/84 M, 84 C, 84 R, 210–212, 220–223
See application file for complete search history.

(56) References Cited

U.S. PATENT DOCUMENTS

| | | | | |
|---|---|---|---|---|
| 3,376,523 | A * | 4/1968 | Kerns | H01F 27/33 333/177 |
| 3,717,876 | A | 2/1973 | Volkers et al. | |
| 4,464,544 | A * | 8/1984 | Klein | H05K 9/0022 336/84 C |
| 4,484,171 | A * | 11/1984 | McLoughlin | H01F 27/362 336/178 |
| 4,660,014 | A * | 4/1987 | Wenaas | H01F 27/06 336/210 |
| 4,977,301 | A * | 12/1990 | Maehara | H01F 27/36 174/393 |
| 5,291,829 | A | 3/1994 | Avory et al. | |
| 5,761,791 | A | 6/1998 | Bando | |
| 5,926,115 | A | 7/1999 | Schleder et al. | |
| 6,040,753 | A | 3/2000 | Ramakrishnan et al. | |
| 6,141,194 | A | 10/2000 | Maier | |
| 6,475,351 | B2 | 11/2002 | Sun et al. | |
| 6,726,857 | B2 | 4/2004 | Goedde et al. | |
| 7,148,779 | B2 | 12/2006 | Wolfgram | |
| 7,394,340 | B2 | 7/2008 | Kakehashi et al. | |
| 8,191,540 | B2 | 6/2012 | Visser et al. | |
| 8,354,911 | B2 | 1/2013 | Visser et al. | |
| 8,836,160 | B1 | 9/2014 | Paterson et al. | |
| 2002/0145416 | A1 | 10/2002 | Attarian et al. | |
| 2003/0164479 | A1 | 9/2003 | Goedde et al. | |
| 2007/0132535 | A1 | 6/2007 | Kakehashi et al. | |
| 2008/0071260 | A1 | 3/2008 | Shores | |
| 2009/0188458 | A1 | 7/2009 | Visser et al. | |
| 2011/0254505 | A1 | 10/2011 | Evander et al. | |

OTHER PUBLICATIONS

RTCA Special Committee 135 (SC-135), "Environmental Conditions and Test Procedures for Airborne Equipment", DO-160F, RTCA, Inc., 2007, Sections 15, 17, 22, 23, and 25.

RTCA Special Committee 180 (SC-180), "Design Assurance Guidance for Airborne Electronic Hardware", DO-254, RTCA, Inc., 2000.

SAE Aerospace, "Aircraft Lightning Zoning", ARP5414 Rev. A, SAE International, 2005.

Department of Defence, "Requirments for the Control of Electromagnetic Interference Characteristics of Subsystems and Equipment", MIL-STD-461F, 2007.

Fisher, F.A. et al., "Lightning Protection of Aircraft", Second Edition, 2004, published by Lightning Technologies Inc., Pittsfield, MA, Fig. 15.1 and Fig. 15.23, pp. 486, 500.

Amrany, Adi; Non-Final Office Action; U.S. Appl. No. 12/892,871; dated May 10, 2013; United States Patent and Trademark Office; Alexandria, VA.

Amrany, Adi; Final Office Action; U.S. Appl. No. 12/892,871; dated Oct. 30, 2013; United States Patent and Trademark Office; Alexandria, VA.

* cited by examiner

SYSTEM AND METHOD FOR VEHICLE POWER SYSTEM ISOLATION

FIELD

This disclosure relates generally to systems and methods for providing electrical isolation for vehicle power systems, and more particularly, to methods and systems for providing electrical isolation using transformer modules between a generator and portions of a power distribution system.

BACKGROUND

Aerospace vehicles such as aircraft are susceptible to lightning strikes and other high intensity radiated fields (HIRF), or collectively voltage spikes or energy spikes. Voltage spikes and induced surges have the potential of interrupting the operation of electrical and control systems within the vehicles. In low-impedance systems, for example in power wiring, induced surges become high-current surges which can trip circuit breakers off-line and disrupt airplane services. In high-impedance systems, for example electronics, induced high-voltage spikes can trip logic, and damage semiconductor avionics. Current generations of aircraft use multiple low-voltage microprocessors, semiconductor devices, and high-frequency data busses, all of which are sensitive to voltage spikes. To mitigate these effects, protection in the form of shielding is used.

For example, in present airplanes with metal fuselages, and especially those produced in last 20 years, at least 90% of the protection required is achieved through the use of metallic shields on critical wiring and cable bundles. The demonstrated best-practice for such shielding (see e.g., "Lightning Protection of Aircraft", Lightning Technologies Inc., Fisher, 2004 (LTI), Ch. 15, FIG. 15.1) is a copper-braid tube wrap on the entire bundle, terminated at each end by a bonded-ring to the connector back-shell, or other grounding methods depending on each individual case (see e.g., LTI, Ch.15, FIG. 15.23.) While shielding has been proven to work quite well in metal airplanes by reducing the external effects by about 6 dB, it still leaves equipment exposed to 1500V spikes and 3000 Amp current surges (see Standards defined in "Environmental Conditions and Test Procedures for Airborne Equipment", RTCA-DO-160E, RTCA Incorporated, 2007 (RTCA-DO-160E), Section 22, 23.) Because of these exposures, Line Replaceable Units (LRUs) typically include levels of internal protection to prevent damage, at extra cost and weight. Skilled workmanship is necessary to design and install copper-braided bundle-shields, and during their lifetime end-terminations are exposed to temperature-stress, current surges, and work-hardening breakages due to cable flexing. Special certification procedures are required for cable-shielding to demonstrate effectiveness to the FAA. Also, life expectancy has to be proven to the FAA, as shields are prone to coming loose and breakages are common.

Transformers used for Transformer-Rectifier 28 Vdc Units (TRUs) do provide some isolation, due in part because the secondary is not connected to the primary, but the isolation is nominal and provides only about −6 dB for the 400 Hz due to the 4:1 turns ratio. This protection is deemed acceptable for metal airplanes under RTCA-DO-160E design rules. Other traditional terrestrial solutions such as metal-oxide varistors (MOVs), diodes etc, have not been used mainly because they are not fault-tolerant, and a single latent-failure renders them useless for airplane purposes.

These solutions serve to mitigate the damage to electronics once a voltage spike is present in the vehicle, but do not prevent the voltage spike from entering the vehicle itself. Many fuselages of aircraft are constructed of metal, which provides some protection to the internal wiring and systems by inhibiting the flow of charge from outside into the enclosed metal fuselage. An enclosed metal structure is sometimes referred to as a "Faraday Cage." In some vehicles, an additional enclosed metal compartment is created within the fuselage to further house and protect flight essential electronics and electrical systems from voltage spikes. However, a recent trend in modern aircraft is to use composite and other non-metal materials, in lieu of metal, in the construction of the vehicle. While these composite materials offer significant reductions in weight, and permit the use of advanced molding methods to achieve perfect aerodynamic forms not previously possible with metal-forming, they also significantly increase risk of damage from electromagnetic fields such as airport radars, high-power radio and TV transmitters Composite materials reduce the beneficial "Faraday Cage" effect of the fuselage, increasing the importance of using other means to prevent voltage spikes from harming the internal systems.

In terrestrial applications, electrical isolation is achieved through transorbs, spark gaps, gas tubes, and transformer isolation. For example, transformers having large volumes of dielectric liquid, or large air gaps, can be used as isolation transformers because there are generally no significant space or weight restrictions. Further, transorbs or components that deteriorate over a number of uses can be easily replaced in terrestrial environments. However, in an aerospace vehicle, there are significant space and weight considerations, and components whose performance deteriorates after every use must be periodically inspected and/or replaced, increasing maintenance time and costs.

SUMMARY

In one an embodiment, a linear optimized isolation transformer may include a magnetic core having a primary side and a secondary side; a primary side winding on the primary side; a primary side terminal electrically coupled to the primary side winding; a secondary side winding on a the secondary side; a secondary side terminal electrically coupled to the secondary side winding; an isolation dielectric placed between the primary side winding and the secondary side winding and having a shape that fills all of the space between the primary side and the secondary side that is not occupied by the core, the isolation dielectric including a permanent high-Q material selected to maintain a high value isolation independent of pressure differences resulting from operation at different altitudes; and wherein the primary side terminal and the secondary side terminal are positioned on opposing ends of a long axis of the magnetic core.

In another embodiment, a linear optimized isolation transformer may include a figure-eight shaped magnetic core having a primary side and a secondary side, and a center core member; a primary side winding on the primary side, the primary side winding having primary wires wound around a first portion of the center core member; a primary side terminal electrically coupled to the primary side winding; a secondary side winding on a the secondary side, the secondary side winding having secondary wires wound around a second portion of the second core member; a secondary side terminal electrically coupled to the secondary side winding; an H-shaped isolation dielectric placed between the primary side winding and the secondary side winding, the isolation dielectric having two crossbar members and a shape that fills all of the space between the primary side and the secondary side that is not occupied by the figure-eight shaped core, the isolation dielectric including a permanent high-Q material selected to maintain a high value isolation independent of pressure differences resulting from operation at different altitudes; and wherein the primary side terminal and the secondary side terminal are positioned on opposing ends of a long axis of the magnetic core.

In yet another embodiment, a method for providing electrostatic and electromagnetic isolation for an electric cable may include placing a linear optimized transformer in line with the electrical cable, the linear optimized transformer including a magnetic core having a primary side and a secondary side; a primary side winding on the primary side; a primary side terminal electrically coupled to the primary side winding; a secondary side winding on a the secondary side; a secondary side terminal electrically coupled to the secondary side winding; an isolation dielectric placed between the primary side winding and the secondary side winding and having a shape that fills all of the space between the primary side and the secondary side that is not occupied by the core, the isolation dielectric including a permanent high-Q material selected to maintain a high value isolation independent of pressure differences resulting from operation at different altitudes; and wherein the primary side terminal and the secondary side terminal are positioned on opposing ends of a long axis of the magnetic core.

The features, functions, and advantages discussed can be achieved independently in various embodiments of the present invention or may be combined in yet other embodiments further details of which can be seen with reference to the following description and drawings.

BRIEF DESCRIPTION OF THE DRAWINGS

The accompanying figures depict various embodiments of the system and method for providing isolation for vehicle power systems. A brief description of each figure is provided below. Elements with the same reference number in each figure indicated identical or functionally similar elements. Additionally, the left-most digit(s) of a reference number indicate the drawing in which the reference number first appears.

DETAILED DESCRIPTION

The following detailed description is merely illustrative in nature and is not intended to limit the embodiments of the invention or the application and uses of such embodiments. Furthermore, there is no intention to be bound by any expressed or implied theory presented in the preceding technical field, background, brief summary or the following detailed description.

There is a need to provide electrical isolation between the power generators in an aerospace vehicle and the internal electronics systems inside the vehicle that use the power from the power generators. Lightning strikes or high intensity radiated fields (HIRF) can create or induce voltage spikes that travel through the power lines leading from the power generators to the internal electronics systems inside the vehicle. The system and method of the present disclosure present a linear optimized isolation transformer for providing isolation for vehicle power systems.

Prior Art Isolation Transformers

Figure 1:
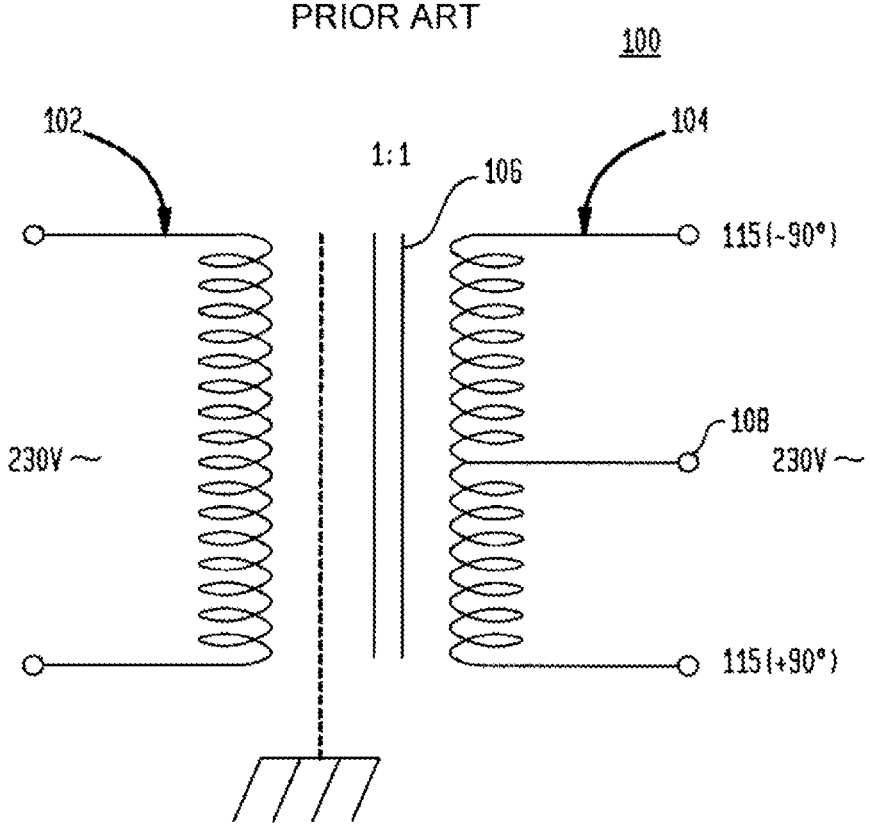
FIG. 1 PRIOR ART
FIG. 1 is a diagram of a conventional isolation transformer.

Referring now to FIG. 1, an electrical diagram of a conventional isolation transformer 100 is presented. Although the conventional isolation transformer 100 is shown for a single phase system, multiple conventional isolation transformers 100 can be used to provide isolation for three phase power systems as would be understood in the art. The conventional isolation transformer 100 has a primary side 102 and a secondary side 104. In the conventional isolation transformer 100, the wires of the primary side 102 are wound over the core 106 of the conventional isolation transformer 100, and the wires of the secondary side 104 are wound over the top of the wires of the primary side 102. The wires are electrically insulated from each other, and the wires of the primary side 102 and secondary side 104 are electrically isolated from each other by a non-conductive electrostatic shield.

Energy transfer from the primary side 102 to the secondary side 104 is effected only by magnetic coupling between the primary side 102 and secondary side 104. By using equal numbers of windings in the primary side 102 and secondary side 104, the conventional isolation transformer 100 provides the same voltage on the secondary side 104 as the voltage presented to the primary 102. The conventional isolation transformer 100 is therefore said to be a 1:1 transformer. By including a center tap 108, a reduced amount of voltage can be obtained on the secondary side 110. For high power applications, the conventional isolation transformer 100 is sometimes placed in a dielectric container filled with a dielectric oil, and the terminals of the primary side 102 and secondary side 104 are physically distanced from one another to prevent arcing between the terminals.

Although the conventional isolation transformer 100 provides good electrostatic isolation between the primary side 102 and the secondary side 104, there is little electromagnetic protection. Because the windings are directly on top of one another, surges on the primary side 102 can be electromagnetically coupled to the secondary side 104. The core 106 acts as a reactive choke to some degree, but the proximity of the wires of the primary side 102 and secondary side 104 enable substantial energy to couple between the wires.

Isolation transformers are seldom used in aircraft because the 115 Vac 400 Hz systems do not have transformers, and the extra weight of two isolation transformers does not trade off well against bundle-shields on the basis of protection from surges. However, one aspect of this disclosure is the design and placement of isolation transformers that prevents surges from occurring, rather than protection from surges that have already entered the vehicle.

System Components and Operation

Figure 2:
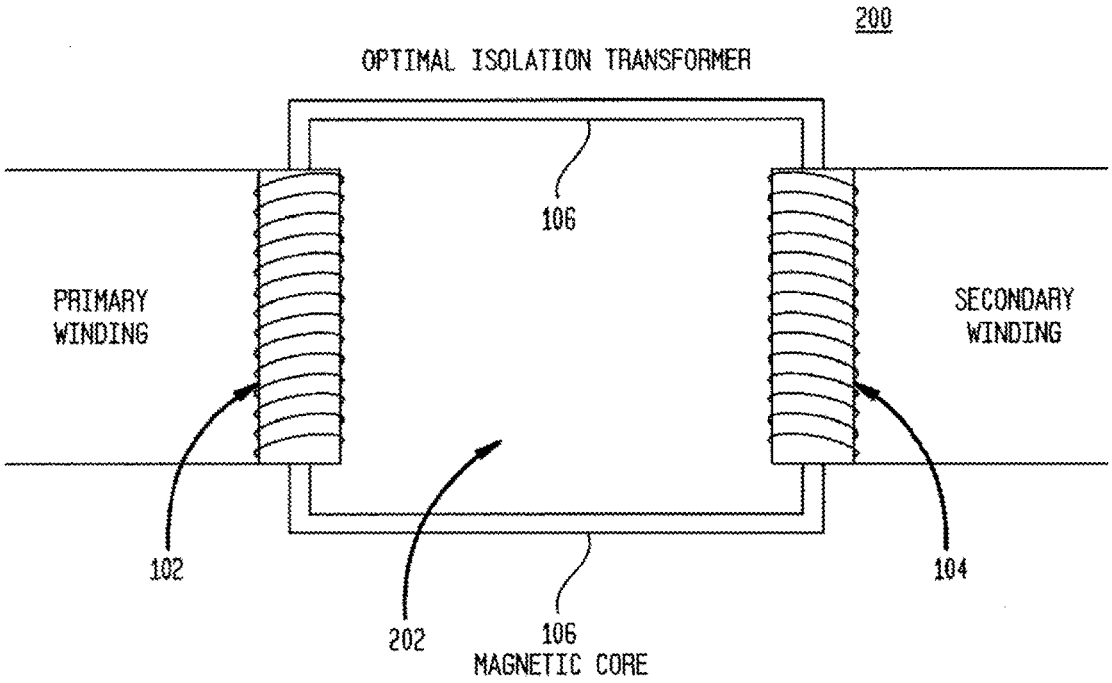
FIG. 2 PRIOR ART
FIG. 2 is a diagram of an optimal isolation transformer in one embodiment of the system and method for providing isolation for vehicle power systems.

Referring now to FIG. 2, an optimal isolation transformer 200 that provides both electrostatic and electromagnetic isolation is presented. The optimal isolation transformer 200 has a primary side 102 and a secondary side 104. In the optimal isolation transformer 200, the wires of the primary side 102 are wound over one part of the core 106 of the optimal isolation transformer 200, and the wires of the secondary side 104 are wound over a different part of the core 106 of the optimal isolation transformer 200. The primary side 102 and secondary side 104 are separated by an air gap 202. The air gap 202 prevents the primary side 102 and secondary side 104 from directly coupling energy, and instead forces all electromagnetic coupling to be performed though the core 106. The core 106 acts as a reactive electromagnetic choke, preventing large amounts of energy at high slew rates, such as those energies induced by a lightning strike, from being coupled from the primary side 102 to the secondary side 104.

However, although the use of an air gap 202 is satisfactory for terrestrial applications, it is not acceptable for use in an aerospace vehicle where operation of the optimal isolation transformer 200 would also occur at high altitudes. This is because voltage breakdown flashover between terminals changes with altitude, in accordance with the Paschen curve.

Figure 3:
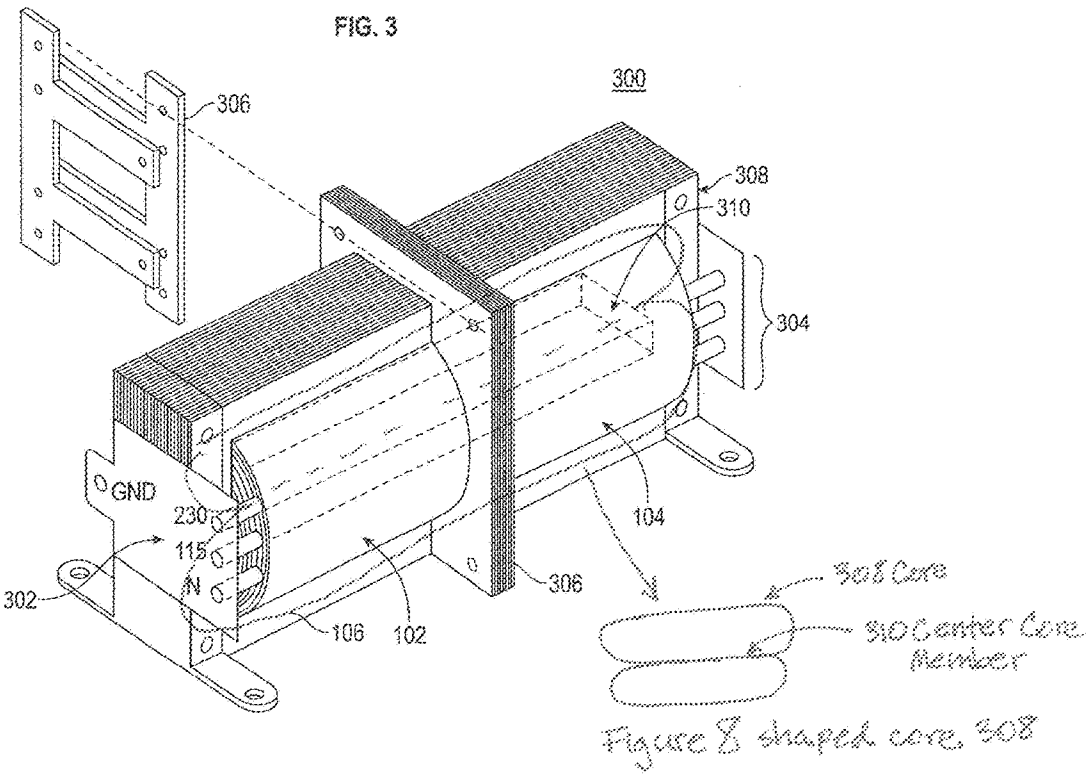
FIG. 3 is a diagram of a linear optimized isolation transformer in one embodiment of the system and method for providing isolation for vehicle power systems.

Referring now to FIG. 3, the solution is to use a permanent high-Q material isolation dielectric 306 between the primary side 102 and the secondary side 104 of a linear optimized isolation transformer 300. The isolation dielectric 306 provides similar electromagnetic isolation as the air gap 202 of the optimal isolation transformer 200 of FIG. 2, but with two additional advantages. First, because the isolation dielectric 306 is not a gas, the isolation dielectric is not affected by changes in altitude as is the air gap 202 of the optimal isolation transformer 200. This feature allows the linear optimized isolation transformer 300 to be used in a wide range of aerospace applications.

Second, because the isolation dielectric 306 can be a higher Q than air, the isolation dielectric permits the primary side 102 and secondary side 104 of the linear optimized isolation transformer 300 to be in closer proximity compared to the primary side 102 and the secondary side 104 of an optimal isolation transformer 200 that employs an air gap 202. This reduces the necessary size or length of the linear optimized transformer 300 compared to the optimal isolation transformer 200. Further, unlike the air gap 202, the isolation dielectric 306 can be configured to extend beyond the core 106, providing further suppression of potential arcing.

In an embodiment of the linear optimized transformer 300, primary wires of a primary side 102 are wound around a first portion of a center core member 310 of a squared-off figure-eight shaped core 308. In an embodiment the core is an iron core. Secondary wires of a secondary side 104 are wound around a second portion of the center core member 310 of the core 308. The figure-eight shaped core 308 may comprise a set of laminated layers configured to reduce eddy currents and associated losses due to eddy currents in the figure-eight shaped core 308. The figure-eight shaped core 308 extends from the primary side 102 to the secondary side 104. An isolation dielectric 306 is positioned between the primary side 102 and secondary side 104, and separates the primary wires of the primary side winding of the primary side 102 from the secondary wires of the secondary side winding of the secondary side 104.

The isolation dielectric 306 is comprised of a set of laminated members having a shape that fills all of the space between the primary side 102 and the secondary side that is not occupied by the figure-eight shaped core 308. In an embodiment, the isolation dielectric 306 is an H-shape having two crossbar members as illustrated in FIG. 3. In an embodiment, the isolation dielectric 306 comprises layer members that interlock to facilitate assembly of the isolation dielectric 306 onto an existing figure-eight shaped core 308. In an embodiment, the isolation dielectric 306 extends beyond the figure-eight shaped core 308 on at least one side, for example by having an additional top crossbar. In another embodiment, the isolation dielectric 306 has an outer diameter greater than the magnetic core 308, the primary side winding of the primary side 102, and the secondary side winding of the secondary side 104. In an embodiment, the isolation dielectric 306 extends beyond the figure-eight shaped core 308 on all sides.

In an embodiment, the primary side terminals 302 and secondary side terminals 304 are provided on opposite sides of the linear optimized transformer 300. In an embodiment, the primary side terminals 302 and the secondary side terminals 304 are positioned on opposing ends of a long axis of the magnetic core 308. This separation of the primary side terminals 304 and secondary side terminals 306 provides superior electrostatic isolation.

In an embodiment, the linear optimized transformer 300 is a 1:1 isolation transformer. In embodiments the linear optimized transformer 300 is a 1:x or x:1 isolation transformer, where x is a real number greater than 1. For example, if the generator provides 230V power, and the system to be powered requires 115 V power, then the linear optimized transformer 300 can be adapted to be a 2:1 transformer. In an embodiment, the linear optimized transformer 300 has one or more taps for 1:x or x:1 power coupling. For example, if two 115 V power systems on the secondary side are to be powered using a single 230 V power source fed to the primary side, then a center tap in the linear optimized transformer 300 can provide power to each 115 V power system, each of which has a 2:1 power coupling ratio. In an embodiment, the linear optimized transformer 300 provides a 1:x step down voltage appropriate for providing power for 28 Vdc avionic systems. In embodiments, the linear optimized transformer 300 further comprises one or more transorbs, gas-discharge tubes, or other semiconductor or equivalent electronics to perform, for example, further R.F. choke or surge protection functionality.

Many aerospace vehicles use generators that are part of, or integrated into, the engines or jet turbines of an aircraft 400. Power from the engines or jet turbines is typically generated as three-phase power. In an embodiment, three linear optimized transformers 300 are used to provide power isolation for each phase of a three-phase power generator.

Figure 4:
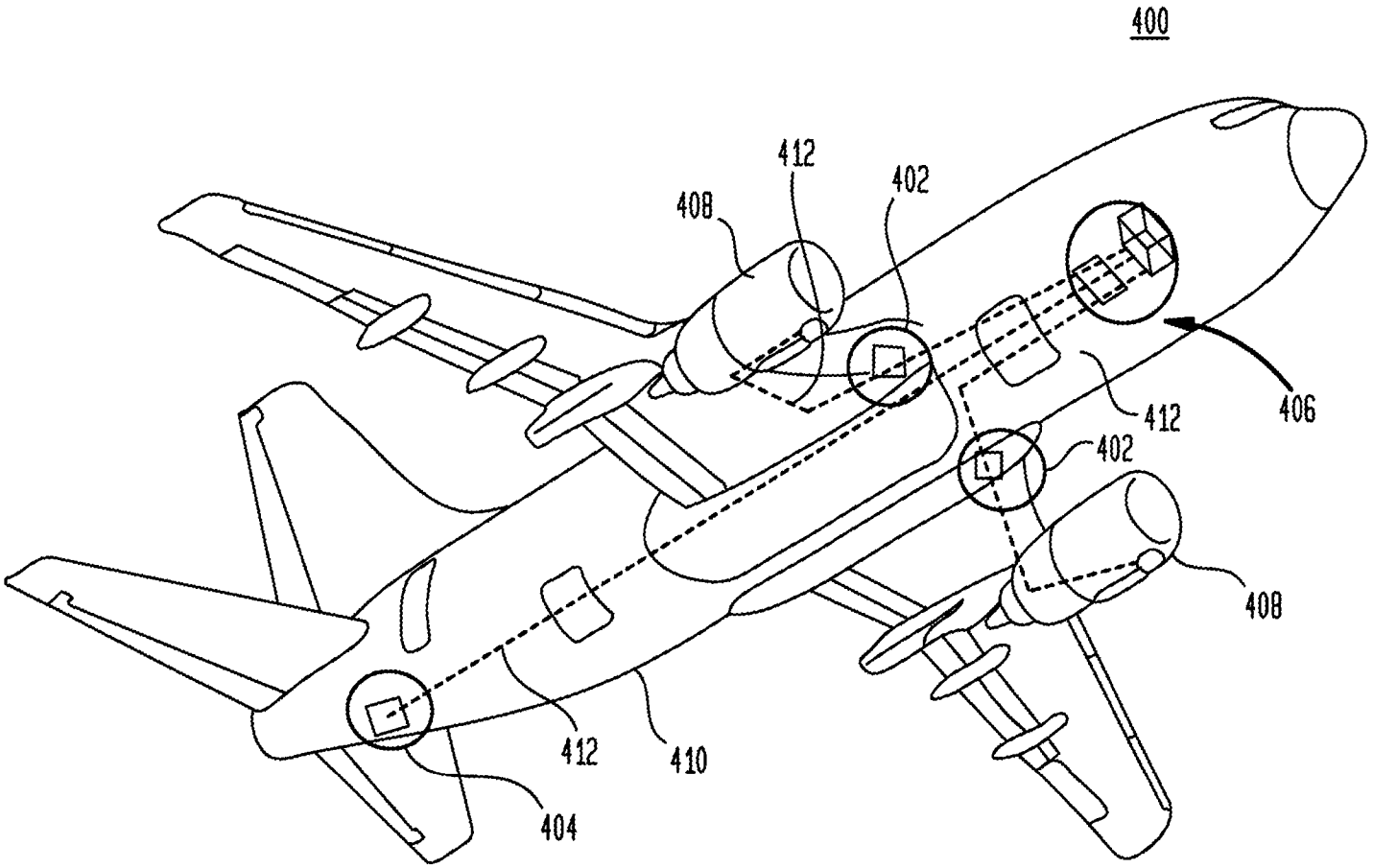
FIG. 4 is a diagram of placement of linear optimized isolation transformers in an aerospace vehicle in one embodiment of the system and method for providing isolation for vehicle power systems.

Referring now to FIG. 4, an aircraft 400 comprises one or more linear optimized transformers 300. Each of the linear optimized transformers 300 is used to isolate power from a generator coupled to a source such as a jet turbine engine 408 or auxiliary power unit or APU 404. In one embodiment, one or more linear optimized transformers 300 is positioned within the wing root 402 where long electrical cables 412 come from the generator associated with the engine 408 into the fuselage 410.

In an embodiment, the primary side terminals 302 reside outside the fuselage 410 in the wing root 402, whereas the secondary side terminals 306 reside inside the fuselage 410.

In this embodiment, the linear optimized transformers 300 help to ensure that charge does not enter the "Faraday Cage" environment of the fuselage 410 through the electrical cables in the wing root 402. In another embodiment, linear optimized transformers 300 are placed near the aft pressure bulkhead near the APU 404 to isolate the long electrical cables 412 leading from the APU 404 to the avionics bay 406 in the front of the aircraft 400. Electric cables 412 leading from the APU 404 to the avionics bay 406 are typically the longest cables and can be 200 ft. or more. Collectively the electric cables 412 and power systems inside the avionics bay 406 comprise a power distribution system. Generally, the longer the aircraft 400 and the longer the electric cables 412, the worse the induction effects become from lightning strikes and other HIRF.

Figure 5:
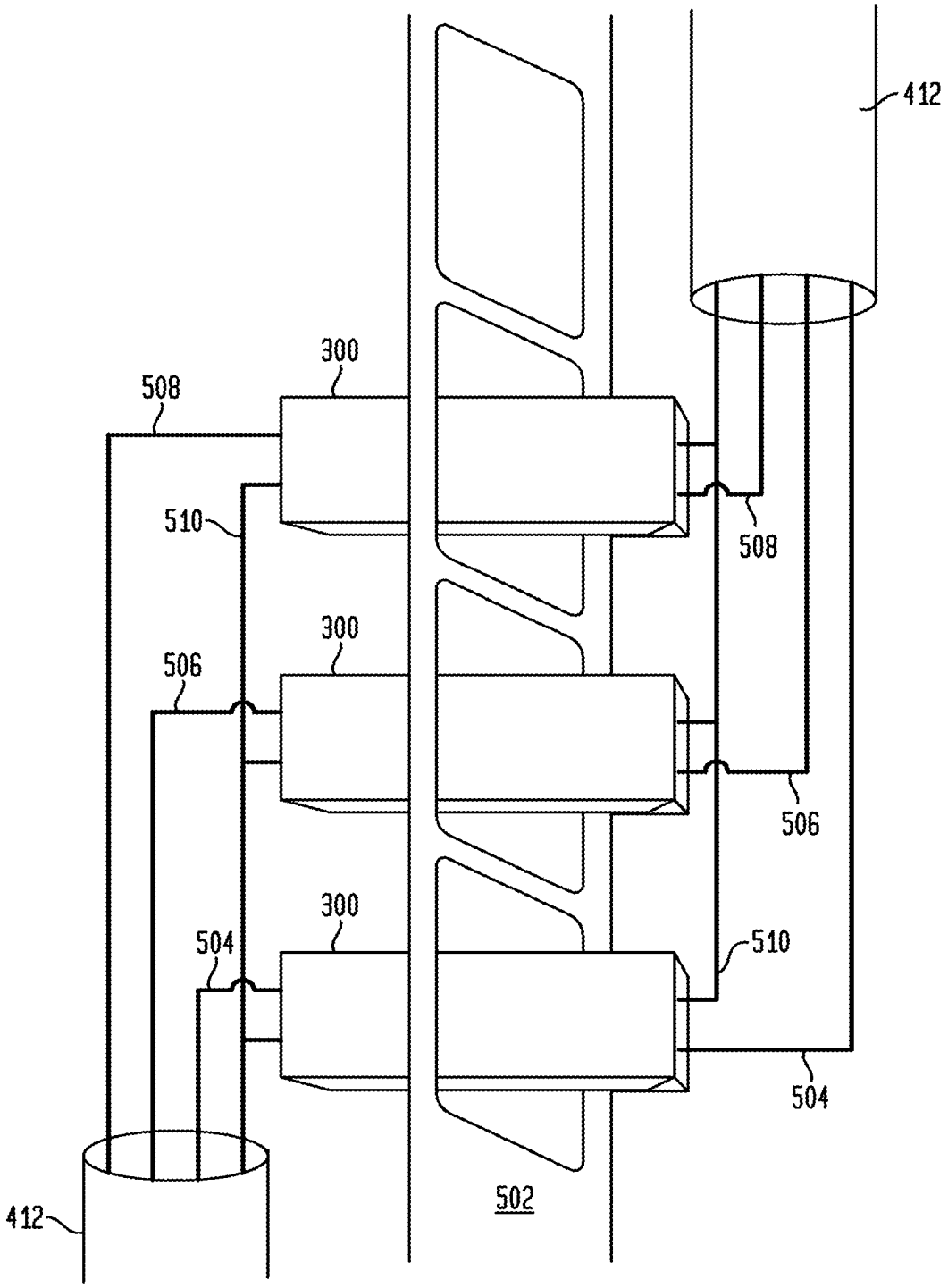
FIG. 5 is a diagram of placement of linear optimized isolation transformers through a structure of a vehicle in one embodiment of the system and method for providing isolation for vehicle power systems.

Referring now to FIG. 5, a diagram of three linear optimized transformers 300 are illustrated passing through a structure 502, for example a structure 502 associated with an aircraft fuselage 410 or wing root 402. Each phase, 504, 506, and 508 of the electrical cable attaches to a different linear optimized transformer 300. The neutral wire 510 from each of the electrical cable 412 connects to the neutral terminals of each of the three linear optimized transformers 300. The linear optimized transformers 300 help to ensure that charge does not pass through the structure 502.

In an embodiment, linear optimized transformers 300 are used to isolate the components and systems inside the avionics bay 406 from the electric cables 412 delivering power from the generator associated with the engine 408 or APU 404. In some aircraft 400, the avionics bay 406 is isolated from the rest of the fuselage 410 by a cage that functions as a Faraday Cage to protect the components and systems inside of the avionics bay 406. The cage serves to protect critical avionics flight control systems and navigation equipment from induced power surges. Passenger entertainment systems and other systems may similarly reside in the cage or in their own cage. In an embodiment, one or more linear optimized transformers 300 are positioned in proximity to the avionics bay 406 to provide power isolation. In a non-limiting example, the primary side terminals 302 reside outside the avionics bay, while the secondary side terminals 306 reside inside the avionics bay 406.

Figure 6:
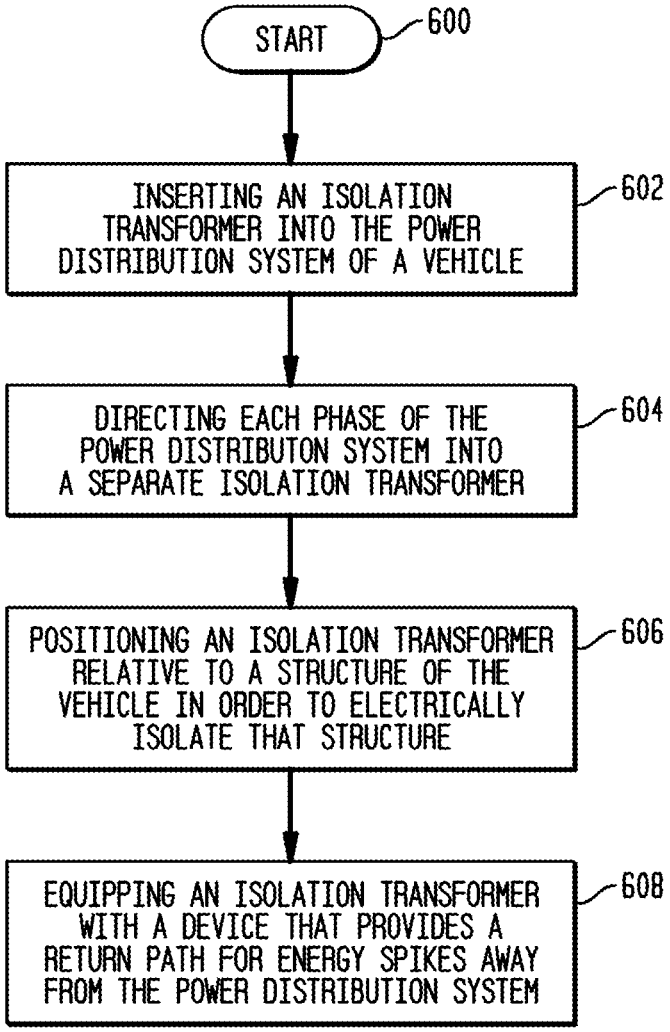
FIG. 6 is a flowchart of a process of placing linear optimized isolation transformers in a vehicle in one embodiment of the system and method for providing isolation for vehicle power systems.

Referring now to FIG. 6, a simplified process 600 of implementing a linear optimized transformers 300 in a vehicle such as an aircraft 400 is presented. In a first step 602, a linear optimized transformer 300 is inserted between the outputs of the generator and the power distribution system. For example, the linear optimized transformer 300 is placed inline with one or more of the electrical cables 412. In embodiments, the generator is on the engine 408 or APU 404.

Because most vehicle generators provide 3-phase power, in a second step 604, each phase of the power distribution system is directed into separate linear optimized transformers 300. In a third step 606, the linear optimized transformers 300 are positioned relative to a structure of the vehicle in order to electrically isolate that structure. In embodiments, the linear optimized transformers 300 are positioned in the wing root 402 in proximity to the avionics bay 406 and in proximity to the APU 404, or placed between electrical cables 412 included in the power distribution system. In embodiments, the linear optimized transformers 300 are co-located, packaged together, or individually positioned independently from one another depending on available space in the vehicle or isolation design parameters. For example, in one embodiment the linear optimized transformers 300 can be separated from one another to prevent a localized lightning strike from affecting all of the linear optimized transformers 300. In another embodiment, the linear optimized transformers 300 are positioned together so that a lightning strike will affect all of the linear optimized transformers 300 in approximately the same temporal frame, and thus any small amount of voltage surge that passes through the linear optimized transformers 300 will be common mode.

In embodiments, in a fourth step 608, the linear optimized transformers 300 are equipped with a device that provides a return path to divert energy spikes away from the power distribution system. For example, one or more transorbs, gas-discharge tubes, or other semiconductor or equivalent electronics will perform additional RF choke or surge protection functionality.

The described system and method mitigates voltages spikes and other high voltage radiated fields or HIRF. The described system and method may provide aircraft power system protection by the use of optimized isolation transformer modules in the aircraft power feeder circuits to provide isolation between the generators coupled to external wiring and the electronics systems inside the fuselage of the vehicle. In an embodiment, the described optimized isolation transformer modules may reduce voltage spikes in an aircraft electrical system from lightning and HIRF by approximately 30 dB, or reduce the induced effects by approximately $1/1000$ volts and $1/10{,}000$ joules of the original voltage or energy. This reduction in the coupling of energy to system inside the vehicle reduces the need to require special treatment in every electronic unit to handle voltage spikes.

The embodiments of the invention shown in the drawings and described above are exemplary of numerous embodiments that may be made within the scope of the appended claims. It is contemplated that numerous other configurations of the system and method for providing electrical isolation for vehicle power systems may be created taking advantage of the disclosed approach. It is the applicants' intention that the scope of the patent issuing herefrom will be limited only by the scope of the appended claims.

What is claimed is:

1. A linear optimized isolation transformer, comprising:

a figure eight shaped magnetic core having a primary side and a secondary side and a center core member extending from the primary side to the secondary side;

a primary side winding on the primary side of the center core member;

a primary side terminal electrically coupled to the primary side winding;

a secondary side winding on the secondary side of the center core member;

a secondary side terminal electrically coupled to the secondary side winding;

an isolation dielectric placed between the primary side winding and the secondary side winding such that the center core member passes therethrough, and having a shape that fills all of the space between the primary side winding and the secondary side winding that is not occupied by the center core member, the isolation dielectric including a permanent high-Q material selected to maintain a high value isolation independent of pressure differences resulting from operation at different altitudes, the isolation dielectric having an outer diameter that extends beyond the diameters of the primary side winding and the secondary side winding about their peripheries; and wherein the primary side terminal and the secondary side terminal are positioned on opposing ends of a long axis of the magnetic core.

2. The linear optimized isolation transformer of claim 1, wherein the magnetic core is an iron core.

3. The linear optimized isolation transformer of claim 1, wherein the figure eight shaped magnetic core is a squared-off, figure eight shaped magnetic core.

4. The linear optimized isolation transformer of claim 3, wherein the isolation dielectric has an H shape that fills all of the space between the primary side and the secondary side that is not occupied by the figure eight shaped core.

5. The linear optimized isolation transformer of claim 4, wherein the isolation dielectric has an additional top crossbar.

6. The linear optimized isolation transformer of claim 5, wherein the isolation dielectric includes a set of laminated members.

7. The linear optimized isolation transformer of claim 1, wherein the isolation dielectric includes two crossbar members.

8. The linear optimized isolation transformer of claim 3, wherein the isolation dielectric includes layer members that interlock to facilitate assembly of the isolation dielectric onto the figure eight shaped core.

9. The linear optimized isolation transformer of claim 1, wherein the isolation dielectric extends beyond the figure eight shaped core on at least one side.

10. The linear optimized isolation transformer of claim 9, wherein the isolation dielectric has an outer diameter greater than a diameter of the magnetic core.

11. The linear optimized isolation transformer of claim 10, wherein the isolation dielectric has an outer diameter greater than the magnetic core, the primary side winding, and the secondary side winding.

12. The linear optimized isolation transformer of claim 1, wherein the linear isolation transformer is a 1:1 isolation transformer.

13. The linear optimized isolation transformer of claim 1, wherein the isolation dielectric extends beyond the magnetic core on all sides.

14. The linear optimized isolation transformer of claim 1, wherein the primary side terminal and the secondary side terminal are positioned on opposing ends of a long axis of the magnetic core.

15. A linear optimized isolation transformer, comprising:

a figure eight shaped magnetic core having a primary side and a secondary side, and a center core member extending from the primary side to the secondary side;

a primary side winding on the primary side, the primary side winding having primary wires wound around a first portion of the center core member;

a primary side terminal electrically coupled to the primary side winding;

a secondary side winding on the secondary side, the secondary side winding having secondary wires wound around a second portion of the center core member;

a secondary side terminal electrically coupled to the secondary side winding;

an H-shaped isolation dielectric placed between the primary side winding and the secondary side winding such that the center core member passes therethrough, the isolation dielectric having two crossbar members and a shape that fills all of the space between the primary side winding and the secondary side winding that is not occupied by the figure-eight shaped core, the isolation dielectric including a permanent high-Q material selected to maintain a high value isolation independent of pressure differences resulting from operation at different altitudes, the isolation dielectric having an outer diameter that extends beyond the diameters of the primary side winding and the secondary side winding about their peripheries; and wherein the primary side terminal and the secondary side terminal are positioned on opposing ends of a long axis of the magnetic core.

16. The linear optimized isolation transformer of claim 15, wherein the isolation dielectric extends beyond the figure eight shaped core on at least one side; and wherein the isolation dielectric includes an additional top crossbar.

17. A power system isolation transformer, comprising:

a linear transformer having a figure eight shaped magnetic core with a center core member extending from a primary side to a secondary side;

the primary side having primary wires wound around a first portion of the center core member;

the secondary side having secondary wires wound around a second portion of the center core member; and an isolation dielectric having an H shape placed between the primary side winding and the secondary side winding such that the center core member passes therethrough, and having a shape that fills all of the space between the primary wires and the secondary wires that is not occupied by the figure-eight shaped core;

wherein the isolation dielectric is made of a permanent high-Q material having a higher Q than air, and includes a set of laminated members having a shape that fills all of the space between the primary side winding and the secondary side winding that is not occupied by the center core member; and wherein the isolation dielectric has an outer diameter that extends about the figure-eight shaped core on all sides.

* * * * *